US009746862B2

(12) United States Patent
Jain

(10) Patent No.: US 9,746,862 B2
(45) Date of Patent: Aug. 29, 2017

(54) VOLTAGE-TO-CURRENT CONVERTER

(71) Applicant: Texas Instruments Incorporated, Dallas, TX (US)

(72) Inventor: Dinesh Jain, Bangalore (IN)

(73) Assignee: TEXAS INSTRUMENTS INCORPORATED, Dallas, TX (US)

( * ) Notice: Subject to any disclaimer, the term of this patent is extended or adjusted under 35 U.S.C. 154(b) by 0 days.

(21) Appl. No.: 14/958,586

(22) Filed: Dec. 3, 2015

(65) Prior Publication Data

US 2017/0160755 A1 Jun. 8, 2017

(51) Int. Cl.
*G05F 1/46* (2006.01)

(52) U.S. Cl.
CPC ..... *G05F 1/461* (2013.01)

(58) Field of Classification Search
CPC . G05F 1/00; G05F 1/461; G05F 1/561; H03F 1/00; H03F 1/3211; H03F 3/00; H03F 3/45179; H03F 3/45197; H03F 3/45475
USPC ..... 327/103
See application file for complete search history.

(56) References Cited

U.S. PATENT DOCUMENTS 5,519,310 A * 5/1996 Bartlett ..... G05F 1/561 323/316

OTHER PUBLICATIONS

Compact Low-Voltage Power-Efficient Operational Amplifier Cells for VLSI; IEEE Journal of Solid-State Circuits, vol. 33 (Issue 10), pp. pp. 1482-1496.*

* cited by examiner

*Primary Examiner* — Lincoln Donovan
*Assistant Examiner* — David Mattison
(74) *Attorney, Agent, or Firm* — John R. Pessetto; Charles A. Brill; Frank D. Cimino

(57) ABSTRACT

A voltage-to-current converter includes an input stage having a first input and a second input. The first input is connectable to a reference voltage, wherein the voltage of the second input is substantially the same as the voltage at the first input. A feedback loop is coupled between the second input and a voltage feedback node. A current feedback node is connectable to a first node of a resistor; the second node of the resistor is connectable to a voltage input, wherein a bias voltage of the current feedback node is set by the voltage of the voltage feedback node. At least one current mirror mirrors the current input to the current feedback node, the output of the at least one current mirror is the output of the voltage-to-current converter.

4 Claims, 3 Drawing Sheets

VOLTAGE-TO-CURRENT CONVERTER

BACKGROUND

Many battery powered electronic devices have very low operating voltages, which limits the input dynamic voltage ranges of these devices. In many low voltage applications, it is difficult to design high performance pre-amplifiers due to the low voltage requirements. For example, a high dynamic voltage swing on an input will saturate many low voltage devices. Some electronic devices use DC level shifting techniques to overcome the low voltage problems, but the DC level shifting techniques have their own problems. For example, some DC level shifting techniques increase the static power consumption of the device and increase the static and dynamic gain error. Furthermore, the DC level shifting techniques can cause higher current noise and may limit the swing of the output signal.

SUMMARY

A voltage-to-current converter includes an input stage having a first input and a second input. The first input is connectable to a reference voltage, wherein the voltage of the second input is substantially the same as the voltage at the first input. A feedback loop is coupled between the second input and a voltage feedback node. A current feedback node is connectable to a first node of a resistor; the second node of the resistor is connectable to a voltage input, wherein a bias voltage of the current feedback node is set by the voltage of the voltage feedback node. At least one current mirror mirrors the current input to the current feedback node, the output of the at least one current mirror is the output of the voltage-to-current converter.

DETAILED DESCRIPTION

Problems exist with electronic devices that operate at low voltage, but require high input dynamic voltage ranges. One such class of devices is microphones in battery operated devices. Preamplifiers associated with the microphones need to have a high input dynamic range to accommodate a wide range of volumes or sound pressure levels (SPLs) received by the microphones. An audio preamplifier may have an input voltage swing that is as low as 10 mV for an electret microphone having typical sensitivity and typical input SPL. A typical preamplifier gain of 32 dB is required to boost the input signal to an appropriate level for signal processing. For an input SPL level of 30 dB to 110 dB, it is very difficult to optimize the gain of the preamplifier. If the preamplifier gain is set to low, there is not enough amplification for inputs at the 30 dB SPL. If the preamplifier gain is set to high, the input signal at 110 dB SPL may saturate the output of the preamplifier, adding to total harmonic distortion (THD) and loss of audio quality.

Some electronic devices and amplification methods attempt to overcome the preamplifier issues, but they all have drawbacks. One method involves log-compression at the input preamplifier; however, this method requires log-domain processing for subsequent amplification stages, which is difficult to implement. Another method involves adaptive and automatic gain control loops. This method is difficult to design and deteriorates the THD for high peak-to-average ratio signals.

Figure 1:
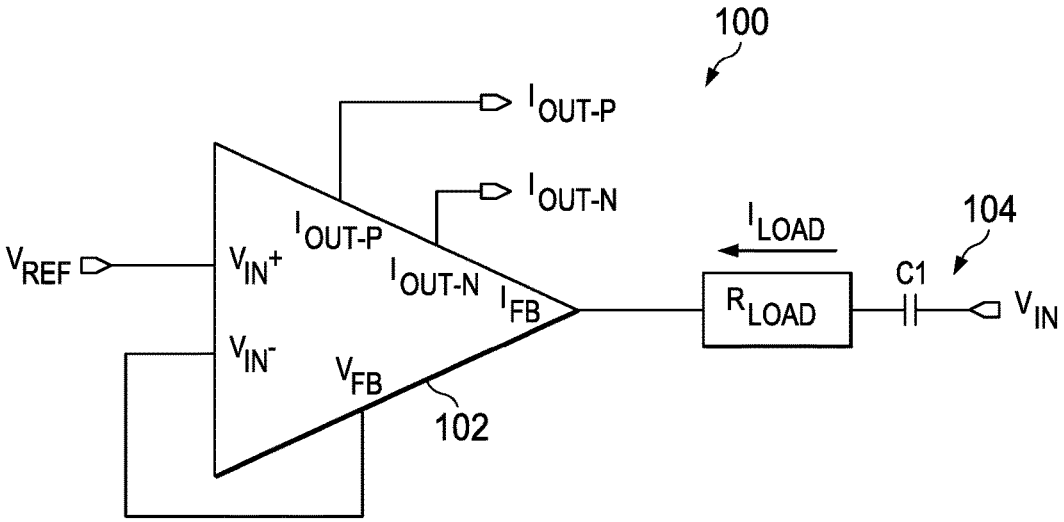
FIG. 1 is a schematic diagram of a voltage-to-current converter.

The methods and circuits described herein accommodate devices with high dynamic voltage ranges by the use of current mode processing. Voltage-to-current converters operating at low voltages and having high input/output dynamic ranges and high input linearity are disclosed herein. FIG. 1 is a schematic diagram of a voltage-to-current converter 100 that overcomes the issues described above. The voltage-to-current converter 100 includes a differential amplifier 102, which is coupled to a load resistor or load resistance $R_{LOAD}$. The differential amplifier 102 has an inverting input $V_{IN}-$, a non-inverting input $V_{IN+}$, and a voltage feedback node $V_{FB}$. The inverting input $V_N-$ and the non-inverting input $V_{IN+}$ are sometimes referred to herein as the first and second inputs, respectively. The voltage potential at the voltage feedback node $V_{FB}$ is sometimes referred to herein as the feedback voltage $V_{FB}$. The non-inverting input $V_{IN+}$ is coupled to a reference voltage $V_{REF}$ that serves as an offset voltage for an input voltage $V_{IN}$ to the voltage-to-current converter 100. The inverting input $V_{IN}-$ is coupled to the voltage feedback node $V_{FB}$ with a unity gain loop. In other examples, the feedback loop may have gain associated therewith. Because of the properties of operational amplifiers, the voltage at the voltage feedback node $V_{FB}$ is the reference voltage $V_{REF}$.

The differential amplifier 102 includes a current feedback node $I_{FB}$ that is coupled to the load resistor $R_{LOAD}$, which in turn is coupled to the input 104 where the voltage $V_{IN}$ is applied during operation of the converter 100. Current flowing through the current feedback node $I_{FB}$ is sometimes referred to herein as the feedback current $I_{FB}$. The current feedback node $I_{FB}$ serves as a virtual ground for the input voltage $V_{IN}$, so the load current $I_{LOAD}$ through the load resistor $R_{LOAD}$ is equal to the difference of voltage $V_{IN}$ at the input 104 and the reference voltage $V_{REF}$ divided by the resistance of the load resistor $R_{LOAD}$. The load current $I_{LOAD}$ is mirrored by the differential amplifier 102 and output as a differential current output $I_{OUT-P}$ and $I_{OUT-N}$. The voltage-to-current converter 100 converts the input voltage $V_{IN}$ to the differential current outputs $I_{OUT-P}$ and $I_{OUT-N}$, which may have a greater dynamic range than provided by conventional amplifiers or preamplifiers that amplify voltage.

Some examples of the converter 100 include a DC blocking capacitor C1 coupled to the input 104. In some situations, it is possible that the DC component of the input voltage $V_{IN}$ is different than the reference voltage $V_{REF}$. Since the feedback current $I_{FB}$ is proportional to the difference between the input voltage $V_{IN}$ and the reference voltage $V_{REF}$, one component would be the DC current corresponding to the difference of the DC voltage of $V_{IN}$ and the DC voltage of $V_{REF}$. This DC component may be undesirable in some applications, so it is eliminated by the use of the DC blocking capacitor C1. In such applications, the current feedback node $I_{FB}$ functions as a virtual ground to the converter 100, so the current flowing through the current feedback node $I_{FB}$ is proportional to the AC component of the input voltage $V_{IN}$.

Figure 2:
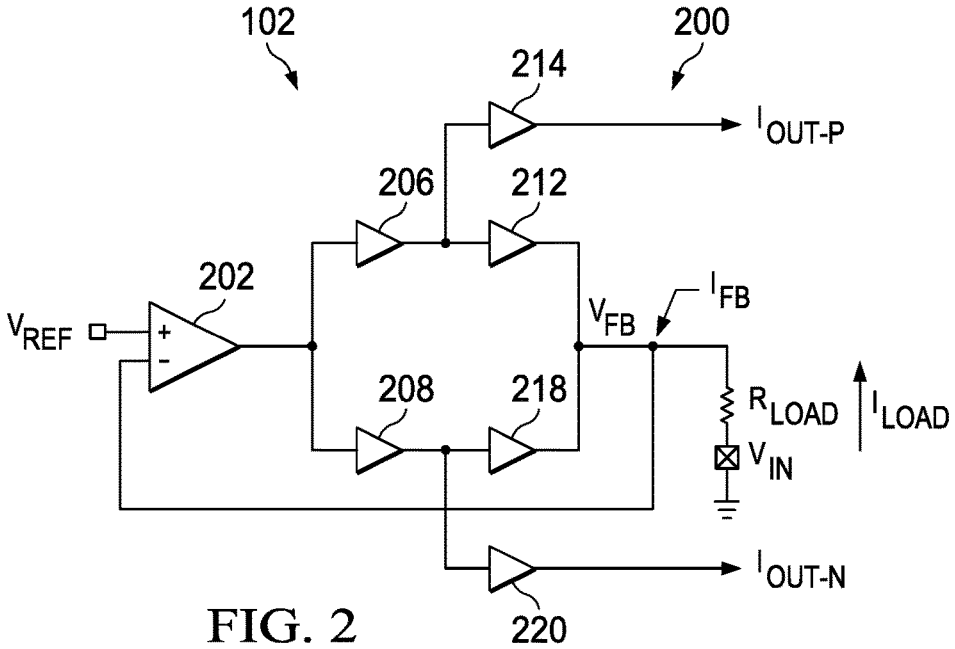
FIG. 2 is a block diagram of an example of a differential amplifier included in the voltage-to-current converter of FIG. 1.

FIG. 2 is a block diagram of a voltage-to-current converter 200, which is an example of the differential amplifier 102 of FIG. 1 with the load resistance $R_{LOAD}$ coupled thereto. The DC blocking capacitor C1 (not shown in FIG. 2) may also be coupled to the converter 200. The components of the converter 200 of FIG. 2 are representative of functional components within the differential amplifier 102. A plurality of other components may be substituted for the described functional components as known by those skilled in the art. The converter 200 has an operational amplifier 202 wherein the non-inverting input of the operational amplifier 202 is coupled to the reference voltage $V_{REF}$ when the converter 200 is operational. The inverting input of the operational amplifier 202 is coupled to the voltage feedback node $V_{FB}$, which is also the current feedback node $I_{FB}$ in the example of the converter 200.

The output of the operational amplifier 202 is coupled to a first level translator 206 and a second level translator 208, which adjust the level of the output of the operational amplifier 202 and/or condition the signal generated by the operational amplifier 202 to be received by the next stage. The first level translator 206 is coupled to a first transconductor 212 and a second transconductor 214. The second transconductor 214 is a replica of the first transconductor 212 and generates a current that mirrors the current of the first transconductor 212. The output of the second transconductor 214 is the output current $I_{OUT-P}$. The output of the first transconductor 212 is coupled to the voltage feedback node $V_{FB}$. The second level translator 208 is coupled to a third transconductor 218 and a fourth transconductor 220. The fourth transconductor 220 is a replica of the third transconductor 218 and generates a current that mirrors the current of the third transconductor 218. The output of the fourth transconductor 220 is the output current $I_{OUT-N}$. The output of the third transconductor 218 is coupled to the voltage feedback node $V_{FB}$.

The input voltage $V_{IN}$ is conducted across the load resistor $R_{LOAD}$, which is coupled to the voltage feedback node $V_{FB}$ and, in this example, the current feedback node $I_{FB}$. The feedback voltage $V_{FB}$ is equal to the reference voltage $V_{REF}$, so the load current $I_{LOAD}$ is equal to the difference between the input voltage $V_{IN}$ and the reference voltage $V_{REF}$ over the load resistance $R_{LOAD}$. The load current $I_{LOAD}$ sinks into the first and third transconductors 212 and 218. The second and fourth transconductors 214 and 220 mirror the currents in the first and third transconductors 212 and 218 to generate the output currents $I_{OUT-P}$ and $I_{OUT-N}$. The loop from the output of the operational amplifier 202 to the feedback voltage $V_{FB}$ provides stability for the converter 200. The dynamic range of the input voltage $V_{IN}$ is established by the reference voltage $V_{REF}$ and the unity gain of the operational amplifier 202, which sets the feedback voltage $V_{FB}$ and thus the load current $I_{LOAD}$.

Figure 3:
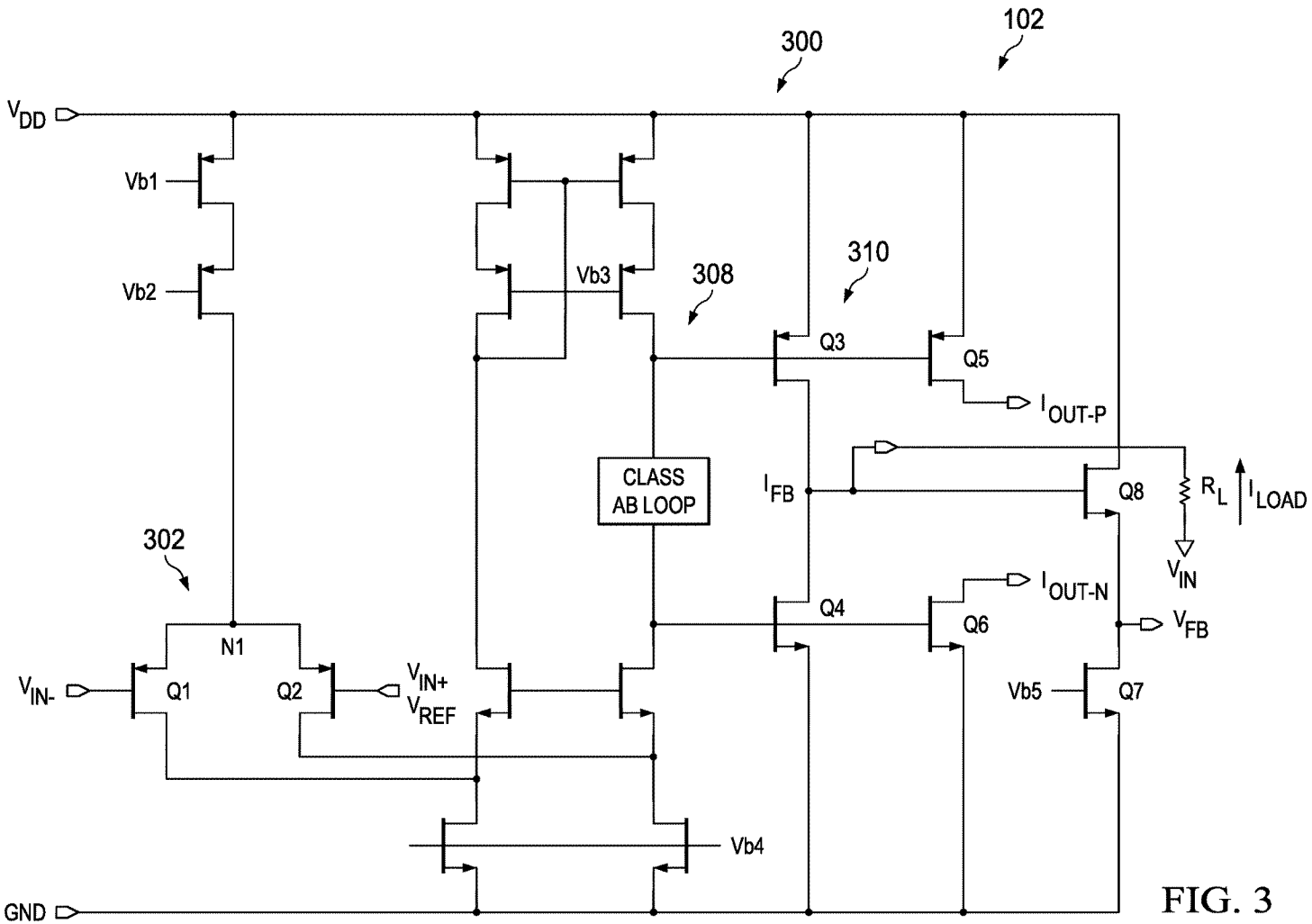
FIG. 3 is a detailed schematic diagram of the differential amplifier of FIG. 1 and the block diagram of FIG. 2.

FIG. 3 is a detailed schematic diagram of a voltage-to-current converter 300, which includes an example of the differential amplifier 102 of FIG. 1 and the converter 200 of FIG. 2. The converter 300 operates from a voltage source $V_{DD}$, which in the example of FIG. 3 is 1.2 volts. The converter 300 has an input stage 302, which is a folded cascode differential input with cascode tail current. The input stage 302 has an inverting input $V_{IN}-$ and a non-inverting input $V_{IN+}$, which correspond to the inverting input $V_N-$ and the non-inverting input $V_{IN+}$ of the operational amplifier 202 of FIG. 2. Accordingly, the non-inverting input $V_{IN+}$ is connectable to the reference voltage $V_{REF}$ and the inverting input $V_{IN}-$ is fed back to the voltage feedback node $V_{FB}$. The input stage 302 includes two FETs Q1 and Q2 that are coupled together at a node N1. The converter 300 includes a plurality of bias voltages Vb1, Vb2, Vb3, Vb4, and Vb5 that are set per design choice.

The output of the input stage 302 is coupled to a class AB loop 308, which in the example of FIG. 3 is a standard translinear bias, such as a Monticelli class AB Loop. The loop 308 includes the level translators 206 and 208 of FIG. 2. The loop 308 further includes or is coupled to transconductors 310 that include FETs Q3 and Q4. The transconductors 310 correspond to the first and third transconductors 212 and 218 of FIG. 2. A FET Q5 serves as a current mirror of the FET Q3 wherein the drain of the FET Q5 is the current output $I_{OUT-P}$. In a similar manner, a FET Q6 serves as a current mirror of the FET Q4 wherein the drain of the FET Q6 is the current output $I_{OUT-N}$.

A FET Q7 is coupled between the voltage feedback node $V_{FB}$ and ground and functions as a current bias for a FET Q8, which functions as a level shifter. The FET Q8 is coupled between the voltage $V_{DD}$ and the voltage feedback node $V_{FB}$ wherein the voltage feedback node $V_{FB}$ is coupled between the source of the FET Q8 and the drain of the FET Q7. The current feedback node $I_{FB}$ is coupled to the gate of the FET Q8 so its potential is the greater than the feedback voltage $V_{FB}$ by an amount equal to the gate/source voltage. In other examples, the channels of the FETs may be reversed so the current feedback node $I_{FB}$ has a higher potential than the voltage feedback node $V_{FB}$. In either situation, the potential of the current feedback node $I_{FB}$ is different than the potential of the voltage feedback node $V_{FB}$. The current feedback node $I_{FB}$ functions as a virtual ground to the resistive load $R_{LOAD}$, therefore, the current $I_{LOAD}$ is equal to $V_{IN}/R_{LOAD}$. The current $I_{LOAD}$ passes through the output of the class AB loop 308 and through the transconductors 310. Accordingly, the load current $I_{LOAD}$ is mirrored into the outputs $I_{OUT-P}$ and $I_{OUT-N}$. In some examples the differential amplifier 102 includes output cascode devices for better matching.

The reference voltage $V_{REF}$ is input to the non-inverting input $V_{IN+}$ of the input stage 302, which functions as an input stage to a unity gain operational amplifier. In some examples, such as where the supply voltage $V_{DD}$ is equal to approximately 1.2 VDC, the reference voltage $V_{REF}$ is equal to approximately 150 mV, so the feedback voltage $V_{FB}$ is also equal to 150 mV DC and serves as a DC bias voltage for the feedback current $I_{FB}$. The DC bias voltage on the feedback current $I_{FB}$ is equal to the feedback voltage $V_{FB}$ plus the gate/source voltage of the FET Q8, which makes the DC bias voltage on the feedback current $I_{FB}$ equal to approximately $V_{DD}/2$ or approximately 600 mv when the converter 300 operates from a 1.2V source.

The input voltage $V_{IN}$ is received from a device, such as a microphone. The device may operate at a low voltage, but may require a high input dynamic range. The input voltage $V_{IN}$ is converted to the load current $I_{LOAD}$ by virtue of the current feedback node $I_{FB}$ serving as a virtual ground. The load current $I_{LOAD}$ conducts through the transconductors 310 and is mirrored as described above. The output of the differential amplifier 102 is the differential output currents $I_{OUT-P}$ and $I_{OUT-N}$.

Figure 4:
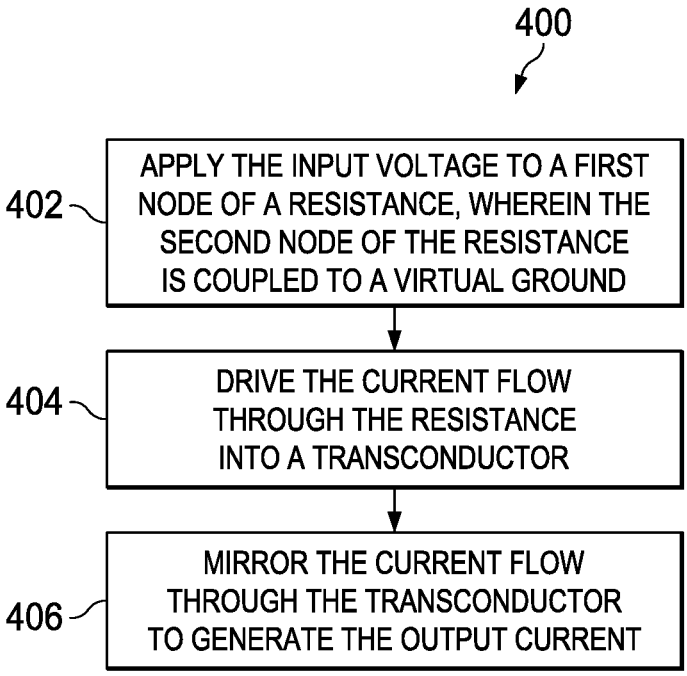
FIG. 4 is a flow chart illustrating an example method of voltage to current conversion.

FIG. 4 is a flowchart 400 describing a method for converting an input voltage to an output current. In step 402, the input voltage is applied to a first node of a resistance, wherein the second node of the resistance is coupled to a virtual ground. In step 404, the current flow through the resistance is driven into a transconductor. In step 406, the current flow through the transconductor is mirrored to generate the output current.

While some examples of passive radiator parameter identification devices and methods have been described in detail herein, it is to be understood that the inventive concepts may be otherwise variously embodied and employed and that the appended claims are intended to be construed to include such variations except insofar as limited by the prior art.

What is claimed is:

1. A voltage-to-current converter comprising:

an operational amplifier having a first input and a second input, the first input being connectable to a reference voltage, the second input being coupled to a voltage feedback node;

at least one transconductor coupled to the output of the operational amplifier, the output of the transconductor being coupled to an input of the converter;

at least one current mirror for replicating the current flow of the output of the at least one transconductor, the current flow of the at least one current mirror being a first output of the converter;

further comprising a resistance, wherein a first node of the resistance is coupled to the input of the converter and a second node of the resistance is coupled to a voltage input.

2. A method of converting an input voltage to an output current, the method comprising:

applying the input voltage to a first node of a resistance, the second node of the resistance being coupled to a virtual ground;

driving the current flow through the resistance into a first transconductor; and mirroring the current flow through the first transconductor to generate the output current.

3. The method of claim 2, further comprising applying a voltage bias to the virtual ground.

4. The method of claim 2, further comprising:

driving the current flow through the resistance into a second transconductor; and mirroring the current flow through the second transconductor to generate a differential output current.

* * * * *